US008668235B2

(12) United States Patent
Mills et al.

(10) Patent No.: US 8,668,235 B2
(45) Date of Patent: Mar. 11, 2014

(54) SPREADER WITH FLIPPER ARM DRIVE

(75) Inventors: Robert Arthur Mills, Lancashire (GB); ZhanMin Tong, Singapore (SG); Ghee Hua Ng, Singapore (SG)

(73) Assignee: NSL Engineering Pte Ltd, Singapore (SG)

( * ) Notice: Subject to any disclaimer, the term of this patent is extended or adjusted under 35 U.S.C. 154(b) by 99 days.

(21) Appl. No.: 13/059,390

(22) PCT Filed: Jul. 1, 2009

(86) PCT No.: PCT/SG2009/000239

§ 371 (c)(1),
(2), (4) Date: Feb. 16, 2011

(87) PCT Pub. No.: WO2010/021596

PCT Pub. Date: Feb. 25, 2010

(65) Prior Publication Data

US 2011/0140470 A1 Jun. 16, 2011

(30) Foreign Application Priority Data

Aug. 19, 2008 (SG) ..... 200806194-7

(51) Int. Cl.
*B66C 1/00* (2006.01)

(52) U.S. Cl.
USPC ..... 294/81.41; 294/81.51

(58) Field of Classification Search
USPC ..... 294/81.41, 81.1, 81.51, 81.53, 81.61, 294/68.3, 81.21, 81.2; 414/607; 212/326, 212/327
See application file for complete search history.

(56) References Cited

U.S. PATENT DOCUMENTS

| | | | | |
|---|---|---|---|---|
| 3,034,659 | A * | 5/1962 | Willison et al. | 212/175 |
| 3,042,227 | A | 7/1962 | Tantlinger | |
| 3,151,904 | A * | 10/1964 | Tantlinger et al. | 294/81.41 |
| 3,885,676 | A | 5/1975 | Wilson et al. | |
| 6,138,846 | A * | 10/2000 | Baumann | 212/326 |
| 6,315,343 | B1 * | 11/2001 | Karlsson | 294/81.41 |
| 2003/0168871 | A1 * | 9/2003 | Geis | 294/81.21 |
| 2008/0089763 | A1 * | 4/2008 | Absalonson et al. | 414/222.07 |
| 2009/0200814 | A1 * | 8/2009 | Hellgren | 294/68.3 |

FOREIGN PATENT DOCUMENTS

| | | | |
|---|---|---|---|
| DE | 10 2007 039 722 | A1 | 2/2009 |
| WO | WO 2007/084052 | A1 | 7/2007 |

OTHER PUBLICATIONS

International Search Report and Written Opinion, with a mailing date of Sep. 30, 2009, for International Application No. PCT/SG2009/000239, filed Jul. 1, 2009 (in 9 pages).

* cited by examiner

*Primary Examiner* — Stephen Vu
(74) *Attorney, Agent, or Firm* — Knobbe Martens Olson & Bear LLP

(57) ABSTRACT

A flipper assembly for guiding a spreader to engage a container is provided, the flipper assembly comprising a flipper hingedly mounted to the spreader, said flipper moveable between an open and closed position about said mounting; a motor mounted to the spreader distal from said flipper; a spacing assembly located between the motor and the hinged mounting of the flipper, wherein said spacing assembly is capable of transmitting a torque from the motor to the hinged mounting so as to move the flipper between the closed and open positions.

12 Claims, 16 Drawing Sheets

SPREADER WITH FLIPPER ARM DRIVE

CROSS-REFERENCE TO RELATED APPLICATIONS

This application is a national phase application filed under 35 U.S.C. §371 for International Application No. PCT/SG2009/000239, filed Jul. 1, 2009, which claims the benefit of Singapore Patent Application No. 200806194-7, filed Aug. 19, 2008, both of which are hereby incorporated by reference in their entirety.

FIELD OF THE INVENTION

The invention relates to the process of engagement of a shipping container by a spreader. In particular, the invention relates to the assemblies used to assist in guiding a spreader into engagement with a container.

BACKGROUND

In order to move a shipping container, a spreader which is attached to a crane, will engage the container at four peripheral points on the upper portion of the container. The engagement of the spreader and container is achieved by what is termed a twist lock engagement which is arranged to provide a quick engagement and disengagement arrangement. The engagement of said twist locks between the spreader and container, however, require a degree of precision which may not be readily available subject to environmental conditions.

To assist the crane operator, flipper assemblies are used to contact the container and guide the spreader so as to align the twist lock engagement between the spreader and container.

Where a container has sufficient clearance around it, typically a spreader will approach from above with all flippers down. Flaring of the bottom portion of the flipper envelopes the corners of the container and permitting the spreader to slide down onto the container using the length of the flippers as a guide. Alternatively if the container does not have sufficient clearance, a spreader may approach from the side with two flippers up and two flippers down. In the "up" position the flippers are clear of the spreader and container and do not participate in the guiding action. The spreader is moved horizontally into proximity with the corners of the container, and then lowered as before using the two down flippers as guides.

When the flippers contact the container, a corresponding impact force is applied. To avoid damage to the flippers from such impact force, particularly if a circumstance leads to a particularly high impact force, the flippers are permitted to "back drive", that is, when a preset torque about the flipper hinge is exceeded corresponding to an unusually high impact force. The back drive capability for a conventional hydraulic flipper is achieved by providing a pressure release within the hydraulic circuit such that on exceeding the pressure, a release operates permitting free rotation of the flipper.

For flippers driven by electric motors, this is more difficult. The corresponding analogy to a pressure release for an electric motor is permitting the gear box to reverse drive when a certain applied force is exceeded. One such measure involves the gear box to back drive by disengaging and operating the motor without a brake and so allow the flipper to move back freely. In this case, the flipper provides no resistance and thus can be back drive freely but is effectively useless as a guide. This lack of a holding torque at the flipper down position is different from that of a hydraulic flipper in that at least a braking pressure can be maintained with a pressure release.

It would, therefore, be preferable to not have the flipper move freely at the down position. Accordingly such systems maintain a brake used at the motor end to brake the motor when the flipper is in the down position as so provide a holding torque.

However, this arrangement can cause substantial damage to the gear box unless safety measures are incorporated. Particularly if the subsequent torque applied to the back drive is high or for a prolonged period.

A further problem with flipper design according to the prior art is the propensity for the motor and gear box to be damaged during operation. With the motor and gear box mounted at the corner of the spreader so as to drive the flipper through the hinged mounting of the flipper to the spreader, this places the motor and gear box proximate to the location of high impact loads either through the flipper or from external contact with other objects.

Further, in order to drive directly through the hinge mounting, it is necessary to locate the motor and gear box at the corner of the spreader so as to be mounted with the flipper. This further reduces the size of the motor and gear box and so limits the rating of either leading to a customised design of the motor and gear box in order to compromise between the contrary design parameters of size and rating.

The prior art shows a motor drive the flipper using a worm gear so as to maintain control and be consistent with the direct drive through the hinged mounting of the flipper. However, whilst applicable to this motor/gear box/flipper arrangement, a worm drive is not useful to provide a back drive capability.

SUMMARY OF INVENTION

In a first aspect the invention provides a flipper assembly for guiding a spreader to engage a container, the flipper assembly comprising a flipper hingedly mounted to the spreader, said flipper moveable between an open and closed position about said hinged mounting; a motor mounted to the spreader distal from said flipper; a spacing assembly located between the motor and the hinged mounting of the flipper; wherein said spacing assembly is capable of transmitting a torque from the motor to the hinged mounting so as to move the flipper between the closed and open positions.

In a second aspect the invention provides a flipper assembly for guiding a spreader for engagement with a container, the flipper assembly comprising a flipper hingedly mounted to the spreader; a motor mounted to the spreader; a spacing assembly between the motor and the hinged mounting of said flipper wherein said spacing assembly includes a torque limiter set at a predetermined maximum torque so as to prevent an applied back drive torque being applied to said gear box by an impact on said flipper. To address the issue of impact, the present invention provides for the motor to be placed away from the corner of the spreader but still provide drive to the hinge mounting of the flipper through a spacing assembly which transmit torque from the motor to the hinged mounting.

Accordingly with the motor and gear box away from the danger zone for high impact, the likelihood of damage to the motor or gear box through such an action may be markedly reduced.

Further advantages achieved by this arrangement include the lifting of restrictions on the size of the motor and gear box. Therefore, a higher rated motor and/or gear box may be provided as compared to that of the prior art as space may be much less of a consideration. This also obviates the need to customize the design and, therefore, reduce manufacturing costs by being able to rely on off-the-shelf equipment.

Further, as placement of the motor and gear box is less critical, these may be placed at more convenient locations that will allow further protection such as within the structure of the spreader itself. Further still in one arrangement a protective guard may be placed around the motor and gear box at the location on the spreaders further protecting the motor and gear box from damage.

With reference to the back drive capability, safety devices may be incorporated within the assembly which provide for both a back drive capability and better protection against the initial high impact load leading to exceeding of the preset limit.

For instance, the gear box instead of relying on a worm drive may now be able to use a planetary gear arrangement or a helical or bevel gear arrangement. In these arrangements the ability to transmit a back drive torque from the flipper to the motor via the gear box may be at a significantly lower risk to damage of the gear box as compared to a worm drive gear box in direct drive engagement with a flipper.

Further still, a torque limiter may be provided in series with the gear box. Such a device may provide slippage when the torque is exceeded and so protecting both the high impact load applied and any subsequent high back drive torque.

In one embodiment of the present invention, the motor and gear box provide torque to the hinged mounting of the flipper through one portion of the hinged mounting. Such an arrangement may require a drive string from the motor and gear box to the hinged mounting to pass through an angle of 45 degrees. It will be noted that a flipper being located at the corners of a spreader may, therefore, be directed at an angle of 45 degrees to the rectangular frame of the spreader. Accordingly, to drive a hinge of the flipper from a motor or gear box which may be located collinear with a framed member of the spreader will require the drive strength to pass through 45 degrees in order to apply the torque.

The means of communicating the torque to the flipper is through a torque transmitter, which may be through a direct engagement with the flipper. The torque transmitter may engage the flipper at a hinge of the flipper. It may further engage two hinges of the flipper. In this way the spacing assembly may act as a drive train or torque train in order to drive the flipper open or closed. The torque transmitter may be a direct linkage such as a universal joint engaging the flipper through one of said hinges.

Alternatively the engagement with the flipper may be through a helical gear. In this case the gear may span between the two hinges of the flipper with the torque communicated to the helical gear in order to drive the flipper. The advantage of the helical gear over a linkage is the ability to vary the gear ratio. For a linkage, the torque is through direct transmission and therefore a ratio of 1:1. However for a helical gear, a reduction ratio may be used by varying the size of the helical gear, for instance 3:1 or 4:1.

Comparing again the linkage to the helical gear, if the gear ratio for the motor is for instance 150:1 and the gear box is of a rating to transmit 2000 Nm to the flipper, the torque limiter may then be set to slip at 2700 Nm.

However, if the helical gear such as a crossed helical gear has a gear ratio of 3:1, the gear box ratio for the same drive may be reduced to 50:1 with the corresponding gear box output torque rating reduced to 667 Nm. Accordingly a torque limiter may then be set to say 900 Nm. This has the result of reducing the size of the gear box and the torque limiter which may save both space and cost.

In a further embodiment, the gear box may be a right angle gear box or alternatively an in-line gear box. An in-line gear box may be particularly useful with the helical gear arrangement as compared to a linkage. By adjusting the gear ratio of the helical gear, the rating, and so size, of the in-line gear box may be reduced so as to fit more compactly. In certain embodiments where a linkage is required, a right angle gear box may be very suitable. However, in reducing size, a helical gear having a reduction ratio set so as to reduce the required gear box rating may permit an in-line gear box, where a more compact assembly may be desirable.

In a still further embodiment, engagement with the flipper may be through use of a bevel gear arrangement in place of the linkage or helical gear set. Similar benefits to the helical gear may be applicable to the bevel gear including adjustment of the gear ratio, yielding the aforementioned benefits.

In a still further embodiment, adjustment of the gear ratio for the cross helical gear or bevel gear may permit a gear box and torque limiter to be sufficiently small so as to fit within the available space. In this case the entire drive train of the spacing assembly may be reduced in size so as to fit more compactly.

BRIEF DESCRIPTION OF DRAWINGS

It will be convenient to further describe the present invention with respect to the accompanying drawings that illustrate possible arrangements of the invention. Other arrangements of the invention are possible and consequently the particularity of the accompanying drawings is not to be understood as superseding the generality of the preceding description of the invention.

DESCRIPTION OF PREFERRED EMBODIMENT

A key feature of the invention is the provision of a spacing assembly between the motor and the flipper which engages a hinge mounting of the flipper to drive the flipper between open and closed positions. The spacing assembly may be referred to as a drive string, a drive train or torque train and is arranged to transmit torque from the motor to the flipper. Components within the spacing assembly may include a gear box, a torque limiter to protect the gear box and motor from impact loading on the flipper. It may further include a shaft upon which the torque limiter may be mounted which delivers the torque from the gear box to a torque transmitter which converts the torque from the shaft to the hinge mounting of the flipper.

The invention encompasses various alternatives to the components based upon varying advantages for different applications. The following drawings illustrate several different alternatives fall within the scope of the invention.

Figure 1:
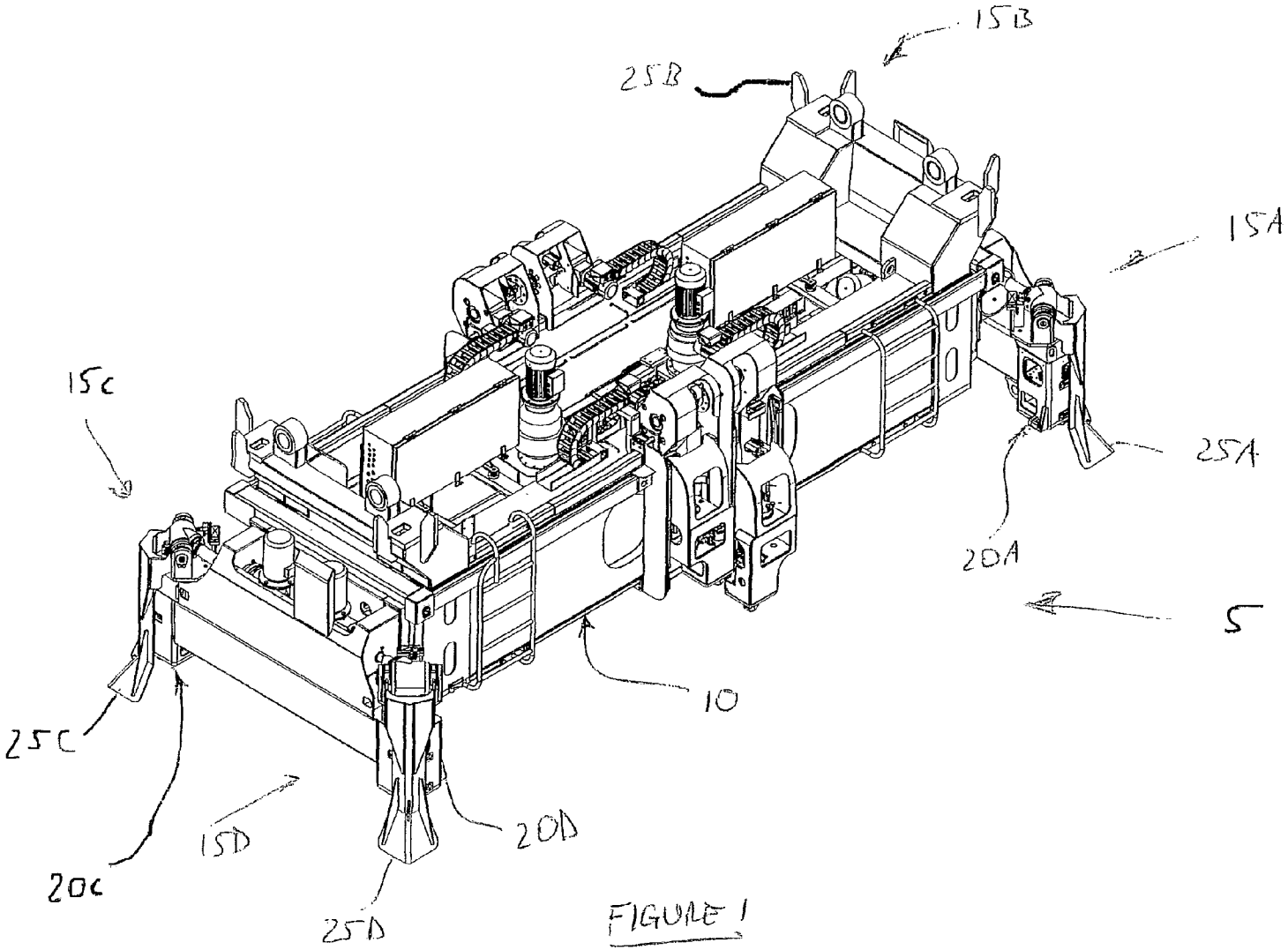
FIG. 1 is an isometric view of a spreader incorporating a flipper assembly according to the present invention.

FIG. 1 shows a spreader assembly 5 according to one embodiment of the present invention. Here a spreader frame 10 has flipper assemblies 15A to D at each corner of the frame 10. The flipper assemblies 15A to D are directed outwards at an inclined angle to the frame 10, such as 45 degrees. In this embodiment, the flippers 25A to D are closed ready for guiding the spreader into engagement with a container.

Engagement with the spreader is achieved through twist lock assemblies 20A to D which require a degree of precision in order to achieve engagement. To achieve this the spreader is brought into proximity with the top of the container and within the tolerance provided by flaring of a bottom portion of the flipper 25A to D. Once within the enlarged area defined by the flared portion, the spreader may be lowered with the flippers acting as a guide to slide these spreaders into contact with the container for subsequent engagement by the twist locks.

It will be appreciated that on bringing the spreader into proximity with the container may result in a high impact load being applied to the flared portion of a flipper. To provide the guiding function to the spreader onto the container, the flipper must resist impact loads with the container if it is to provide a guiding function. It will be appreciated that as the spreader approaches contact with the container, a considerable amount of "rattling" of the spreader as it "bounces" around the flippers as the container is approached. Eventually the spreader will contact the container and through guidance by the flipper, be in an engagement orientation to a high degree of precision so as to engage the twist locks.

During this lowering, the "rattling" or "bouncing" can lead to impact loads which must be resisted by the flipper. However, the initial contact between a flipper and the container as the spreader is first lowered may be considerably higher than that normally experienced during the sliding portion. If this very high impact load is too high without safety precautions, the flipper may be damaged and therefore not be able to provide a guiding function. The guiding function is directly related to the speed with which containers can be engaged and, therefore, a damaged flipper can affect the efficiency of the process. Accordingly repairing a flipper is an important exercise even though it may put a spreader out of commission during the repair process. It would, therefore, be preferable for a flipper to be able to resist normal impact loads but under a high impact, be able to release before damage is caused.

Figure 2A:
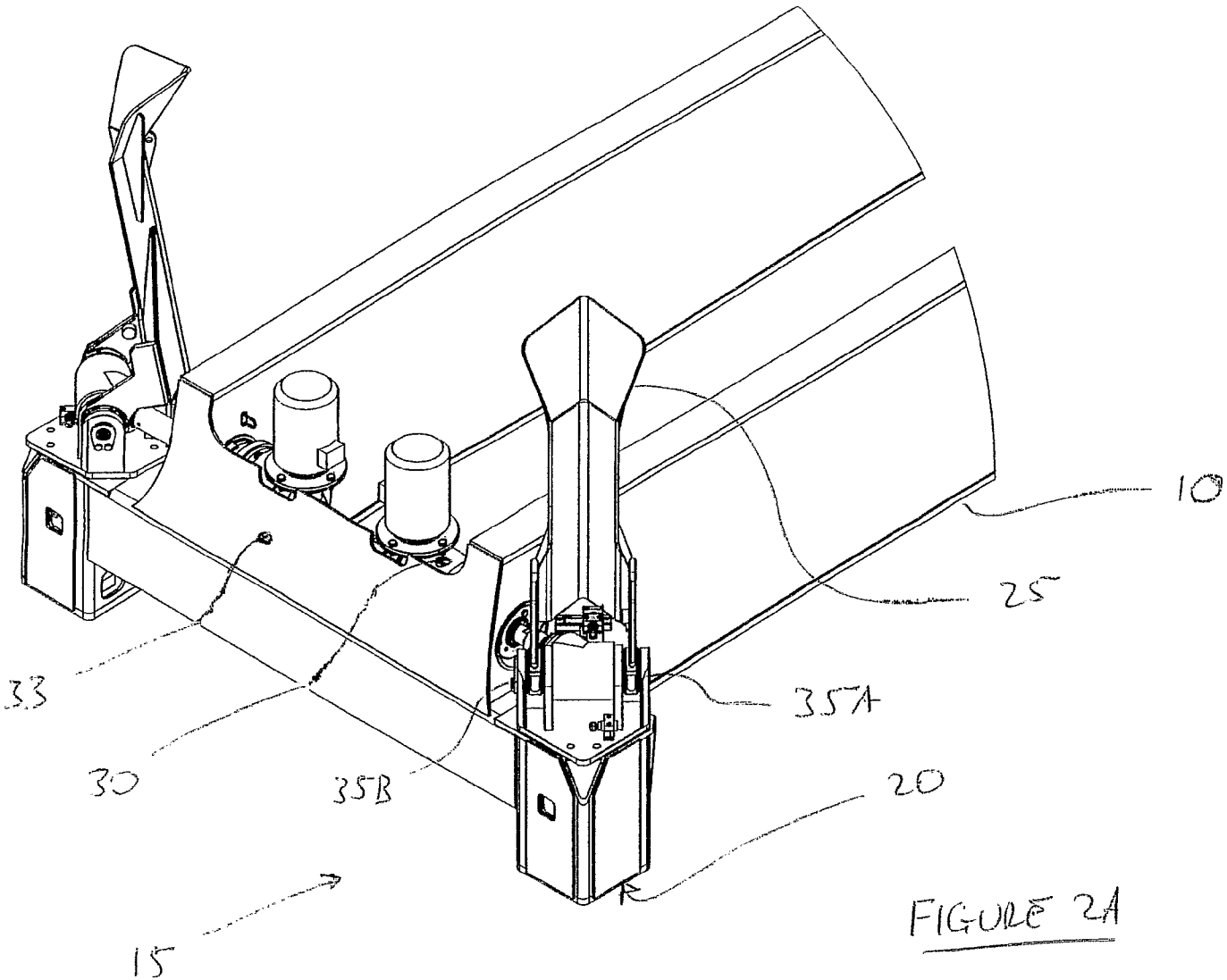
FIG. 2A is an isometric view of the flipper assembly according to one embodiment of the present invention with the flipper in the open position.
Figure 2B:
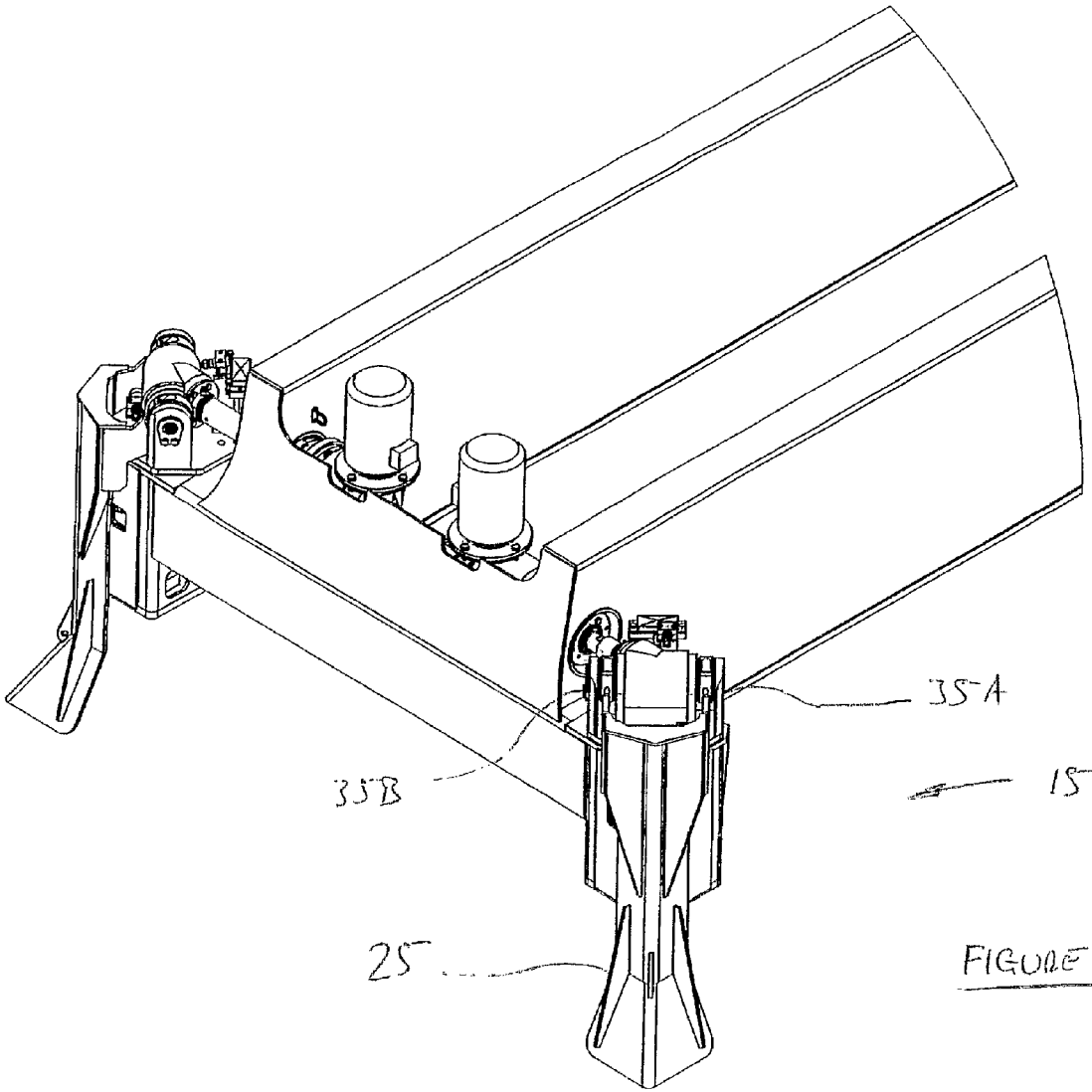
FIG. 2B is an isometric view of the flipper assembly of FIG. 2A with the flipper in the closed position.

FIGS. 2A and 2B show a flipper assembly according to the present invention with FIG. 2A having the flipper 25 in an open position and FIG. 2B having the flipper 25 in a closed position. The flipper assembly 15 includes a hinged mounting 35A, B about which the flipper 25 can rotate. Located within the frame 10 of the spreader is the motor and gear box 30 protected by a protective plate 33. It will be noted that it is positioned away from the flipper 25 through a spacing assembly (not shown).

As discussed high impact loads during the container engagement process may be experienced. For a gear box and motor located proximate to the flipper, these high impact loads occur very close to the motor, leading to the potential for the motor to also be damaged. Further by providing a direct drive to the hinged mounting of a flipper, the motor may not readily be able to resist a "back drive" which as discussed is required for the safe operation of a flipper. As will be discussed, the present invention having located the motor and gear box distal from the flipper 25, allows for a range of benefits including embodiments having safety equipment within the overall assembly.

Figure 2C:
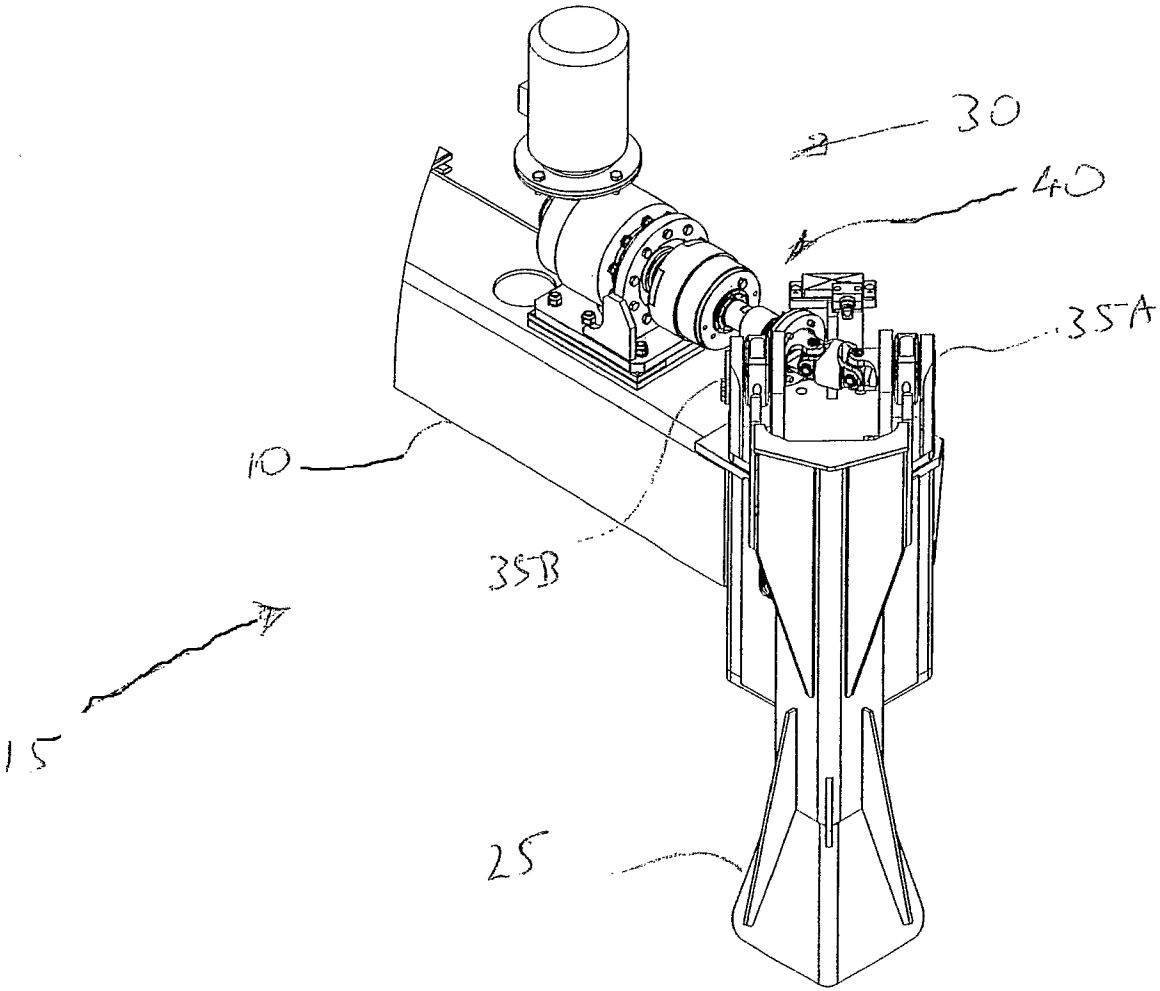
FIG. 2C is an isometric view of a flipper assembly according to one embodiment of the present invention showing the spacing assembly.

FIG. 2C shows the flipper assembly 15 comprising a motor 30, a spacing assembly 40, including a gear box, and a flipper 25 which is mounted to a frame 10 of a spreader.

Mounting occurs through a hinged mounting 35A, B with the spacing assembly mounted to one such hinged mounting 35A. For clarity much of the frame 10 has been removed including the protective plate 33 which is used to protect the motor and gear box from external damage.

Figure 3:
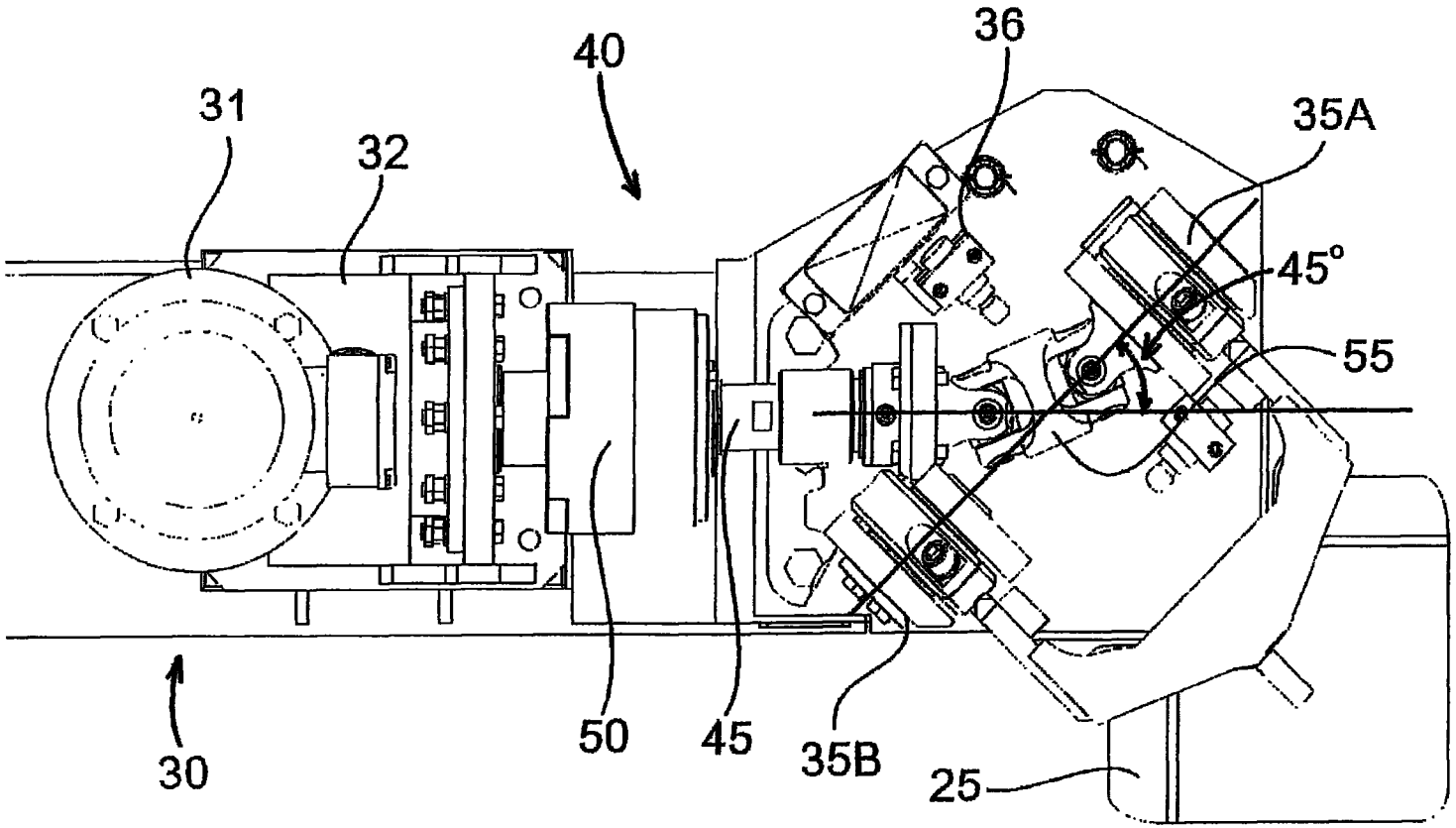
FIG. 3 is a plan view of the flipper assembly of FIG. 2C.

FIG. 3 shows a plan view of the assembly 15 with the motor 31 mounted to the gear box 32 which in turn is mounted to the spacing assembly 40. The spacing assembly 40 includes a drive string, or drive train, having a shaft 45 and a torque limiter 55 in-line with the shaft 45. Connection of the spacing assembly 40 to the hinged mounting 35A, B is through one of said hinged mountings 35A through a linkage 50 being a universal joint capable of transmitting the torque applied by the motor 31 to the hinged mounting 35 sufficient to drive the flipper 25 from an open to closed position. Further, the linkage 55 within the spacing assembly 40 is capable of transmitting a back drive torque where the flipper must suffer a release on application of a particularly high impact load.

In this case, the motor 31 is a servo-motor to assist with maintaining resistance against torque during the back-drive. Further, even when stationary, as a result of the feedback capability, the servo-motor will maintain the resistance against the torque, as compared to a conventional electric motor which cannot provide a continuous force against the applied forces from the flipper assembly. Accordingly, as the applied torque is maintained, or even periodically increased during use, the servo-motor automatically compensates for the applied torque.

This embodiment provides substantial benefits over the prior art in that the linkage 55 is not subject to the same damage that a worm drive in direct connection to a hinged mounting may suffer on back drive torque being applied. Further, the provision of a torque limiter 50 provides for a slippage when such a high impact load is applied and so preventing damage to the gear box when the torque reaches a particular level.

Such a torque limiter may be provided by a number of different arrangements. Such torque limiters are available as proprietary items and the appropriate device can be provided as will be appreciated by the skilled person. One such device is the ROBA™ type 132. This device is a positive locking flexible safety clutch with adjustable torque for connecting to shafts. The flexible coupling component is designed as a positive locking claw coupling. The input and the output can be disconnected without dismantling the clutch. The torque is transmitted via an interchangeable flexible intermediate ring. Other such devices may be suitable and may be used accordingly.

As the gear box is less constrained for size, as compared to the prior art, a range of torque resistant gear arrangements can be used. Whereas a worm drive is required for a gear box of the prior art, in this case a planetary gear box or a gear box having helical or bevel gears may be incorporated. As size is less of a consideration, a higher rated gear box may be used so as to overcome anticipated back drive torques.

Figure 4:
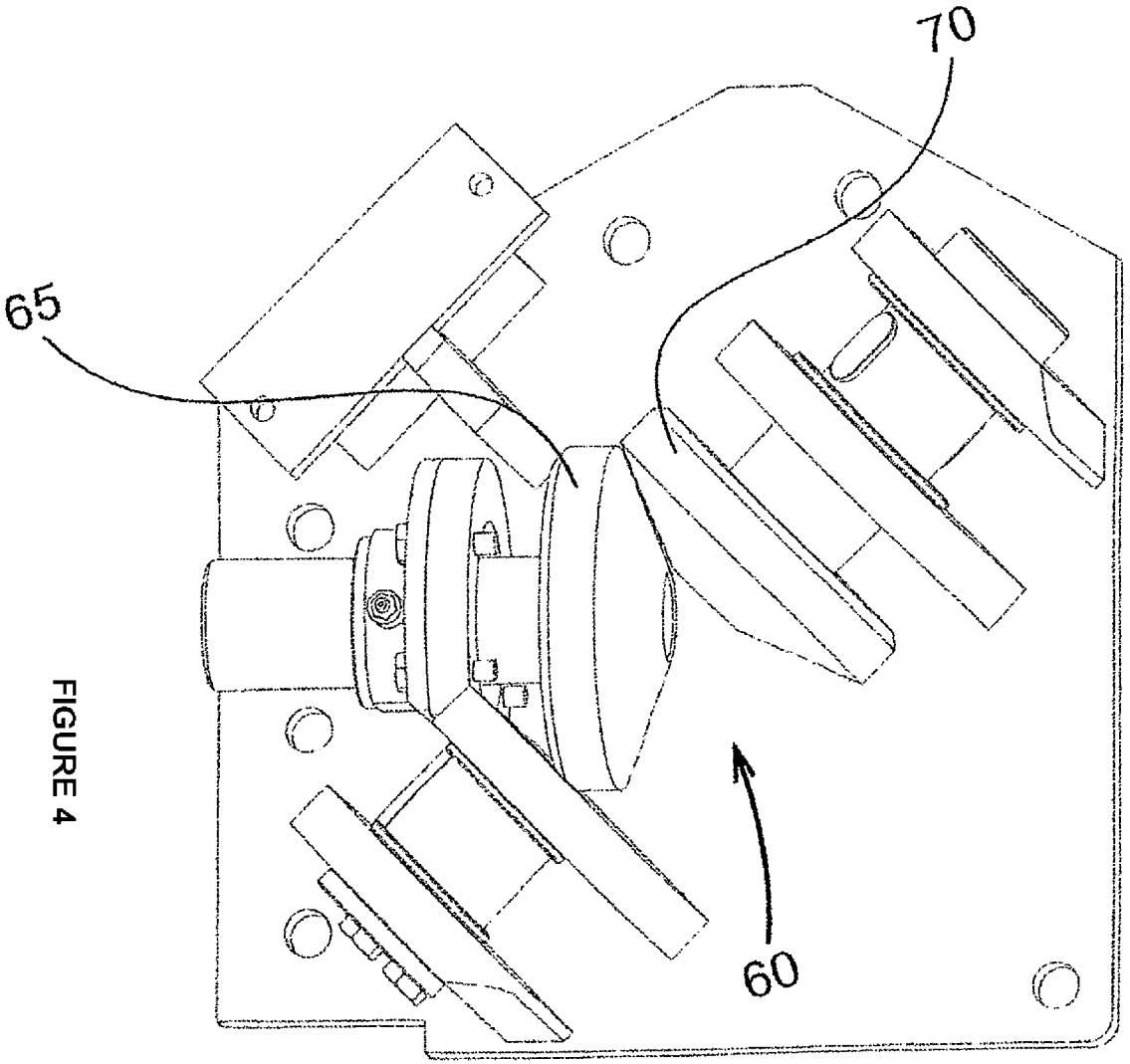
FIG. 4 is a plan view of the spacing assembly according to a further embodiment of the present invention.

In this arrangement it will be noted that drive of the hinged mounting 35A must be applied at 45 degrees to the direction of the drive strength. The application of the linkage 55 achieves this result. An alternative arrangement is shown in FIG. 4 whereby a bevel gear 65, 70 may also be used to provide the drive from the drive strength to the hinge mounting. Further a lubrication nipple 36 is also applied as a means of maintaining lubrication to the joint as an automatic process.

Figure 5A:
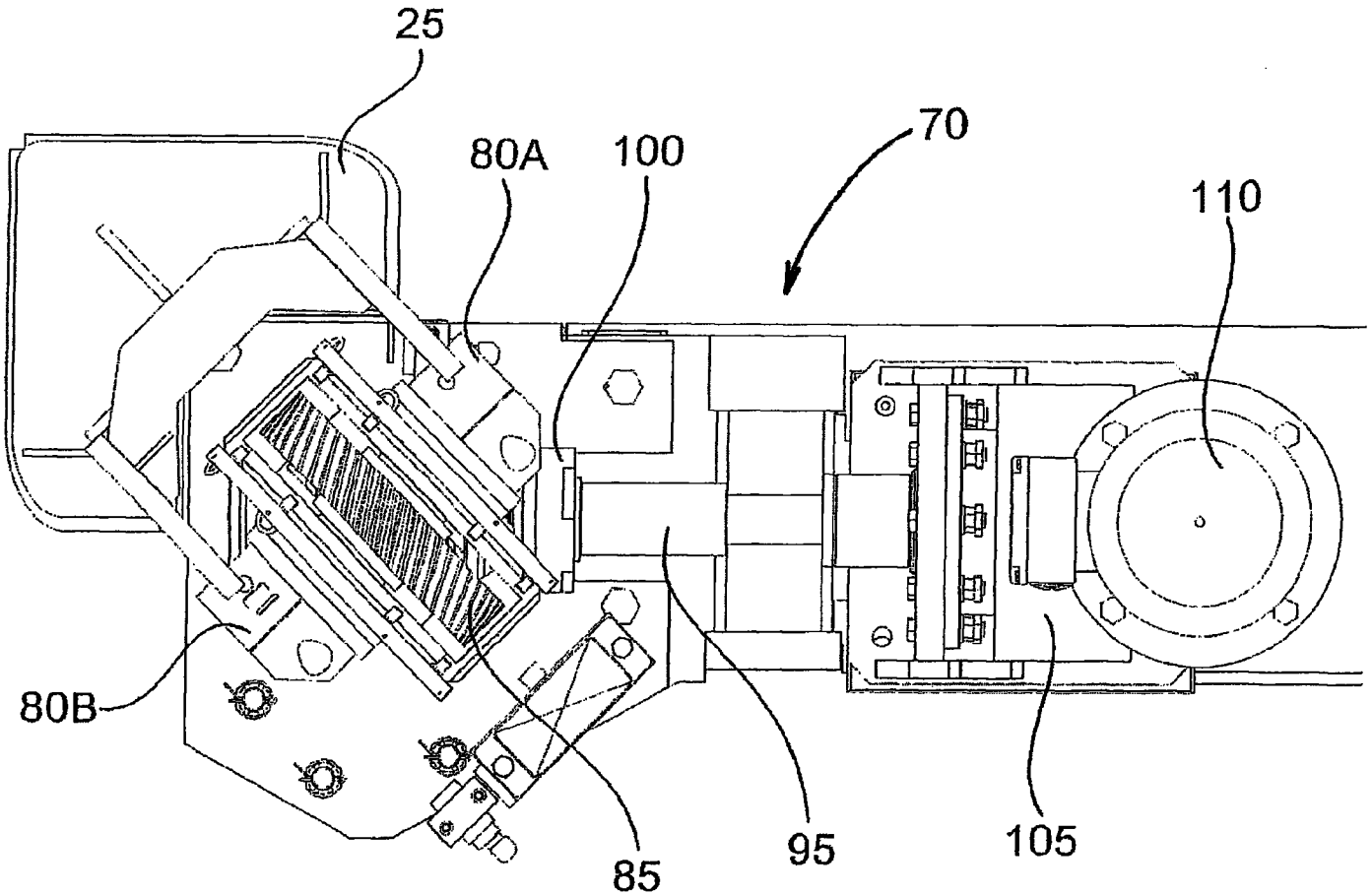
FIGS. 5A and 5B are various views of a spacing assembly according to a further embodiment of the present invention.
Figure 5B:
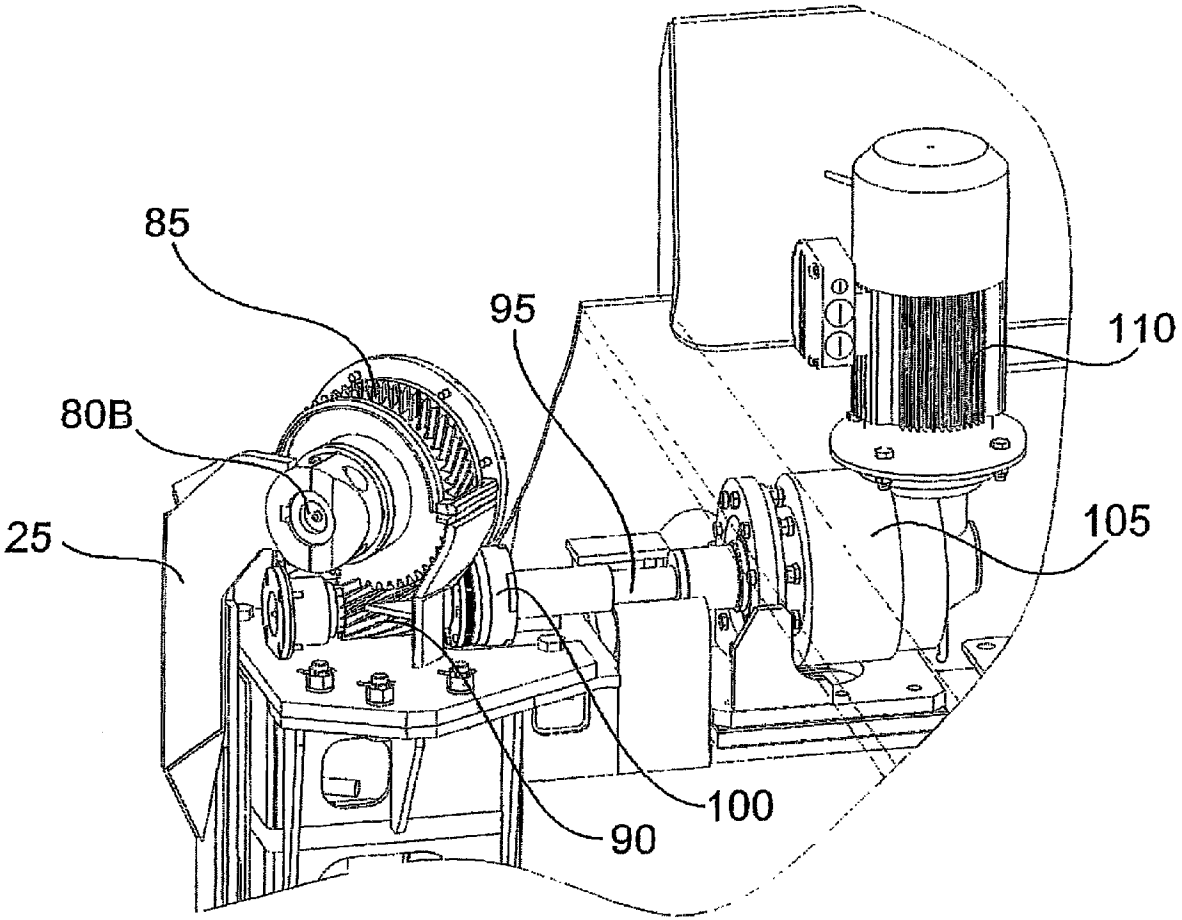

FIGS. 5A and 5B show an alternative arrangement of the spacing assembly 70 whereby a right angle gear box 105 connects to a shaft 95 which in turn connects to a torque limiter 100 and a torque transmitter assembly 85, 90. Here a cross helical gear 85,90 is mounted between the two hinges 80A, B such that the cross helical gear coupling between the shaft mounted gear 90 and the hinge mounted gear 85 drive both hinges 80A, B of the flipper 25. It will be noted that the cross arrangement of the coupled gears 85, 90 permit the re-direction of the transmitter torque through an angle of 45 degrees. This permits the spacing assembly 70 to be mounted to the frame of the spreader and still drive the flipper 25 which is angled at 45 degrees to the spreader frame.

Another feature of the embodiment of FIGS. 5A and 5B is the ability to manipulate the gear ratio between the coupled helical gears 85, 90. The shaft mounted gear 90 can be of a diameter comparable to the shaft whereas the hinge mounted gear 85 is of significantly larger diameter. In this embodiment the gear ratio is approximately 4:1. Such a gear ratio is not possible with a direct connection such as through a linkage as demonstrated in the arrangement of FIG. 3.

Figure 6A:
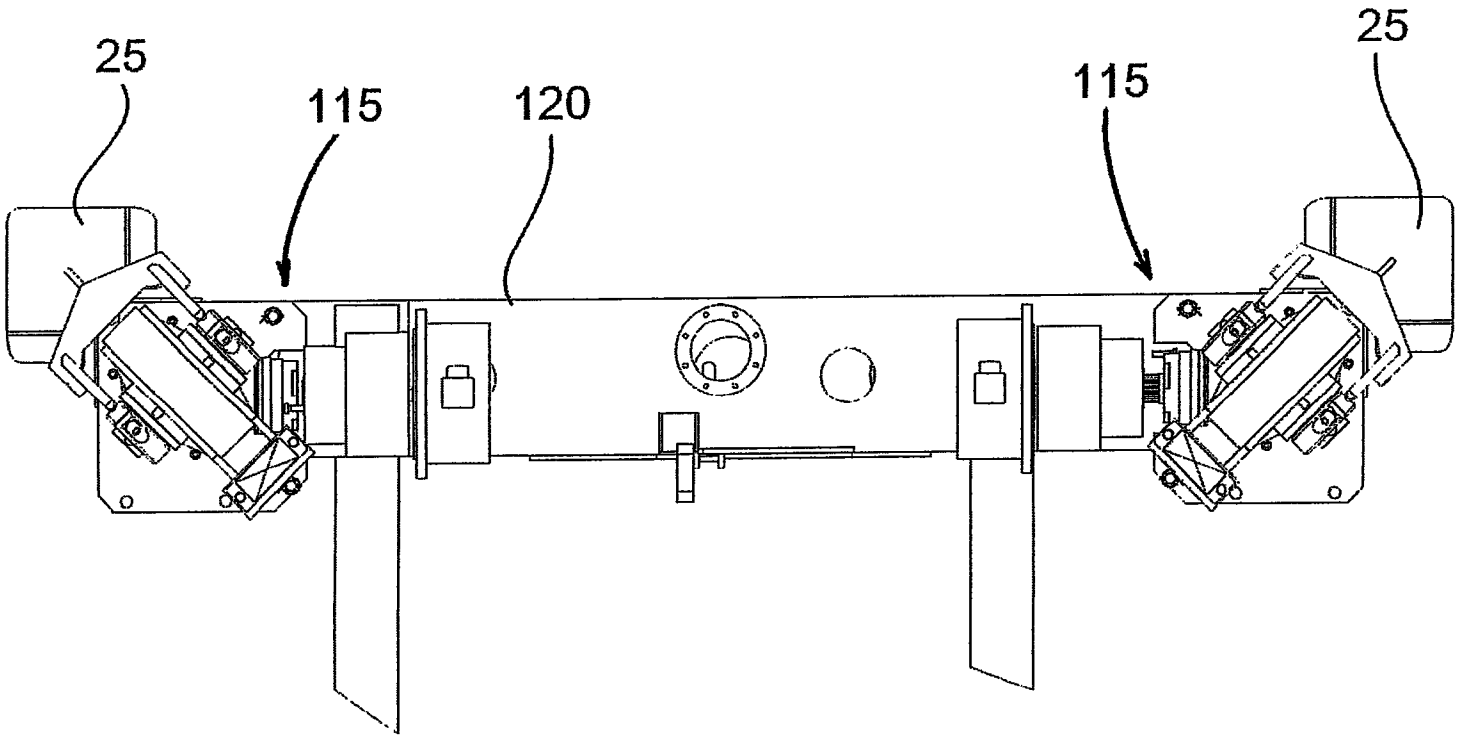
FIGS. 6A to 6C are various views of a spacing assembly according to a further embodiment of the present invention.
Figure 6B:
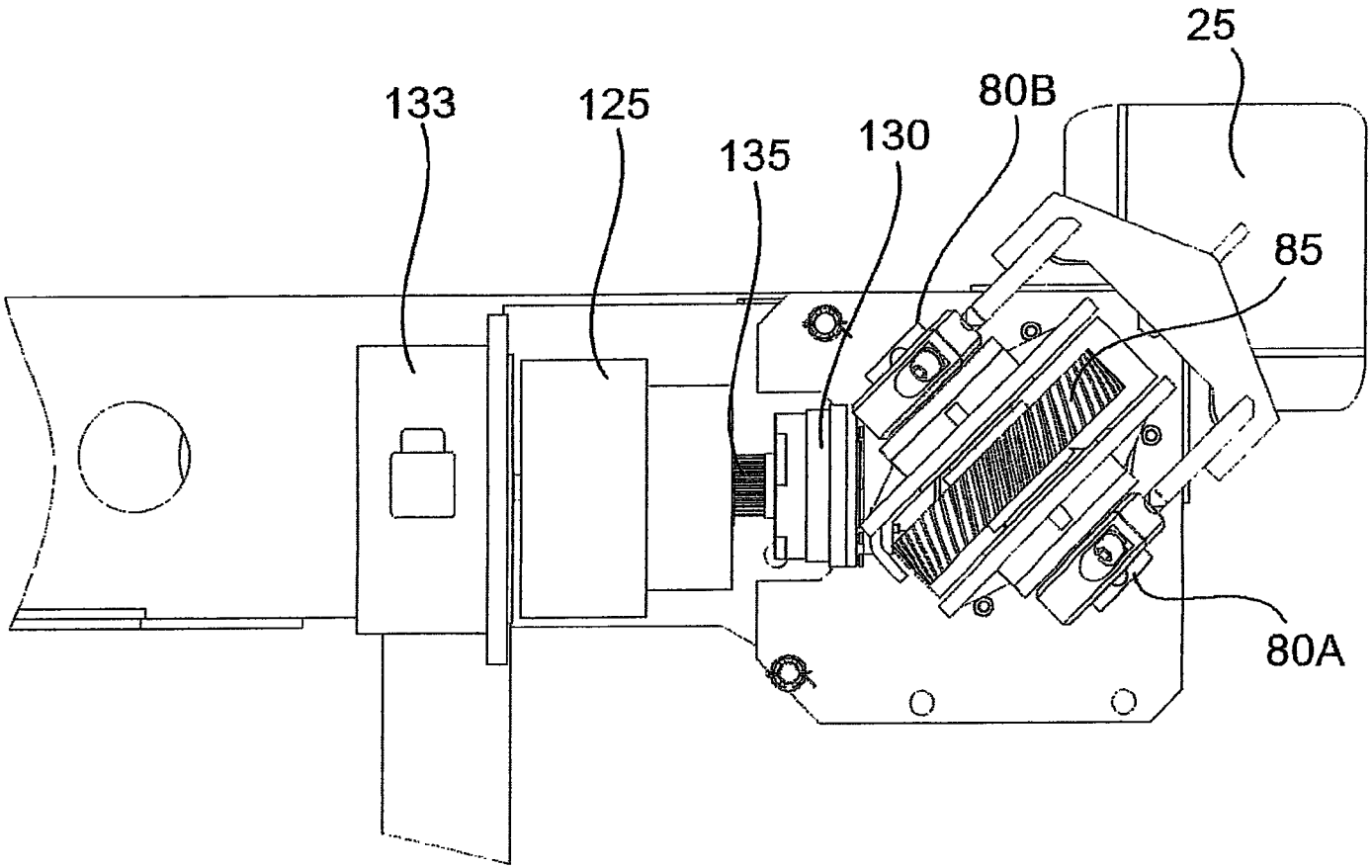
Figure 6C:
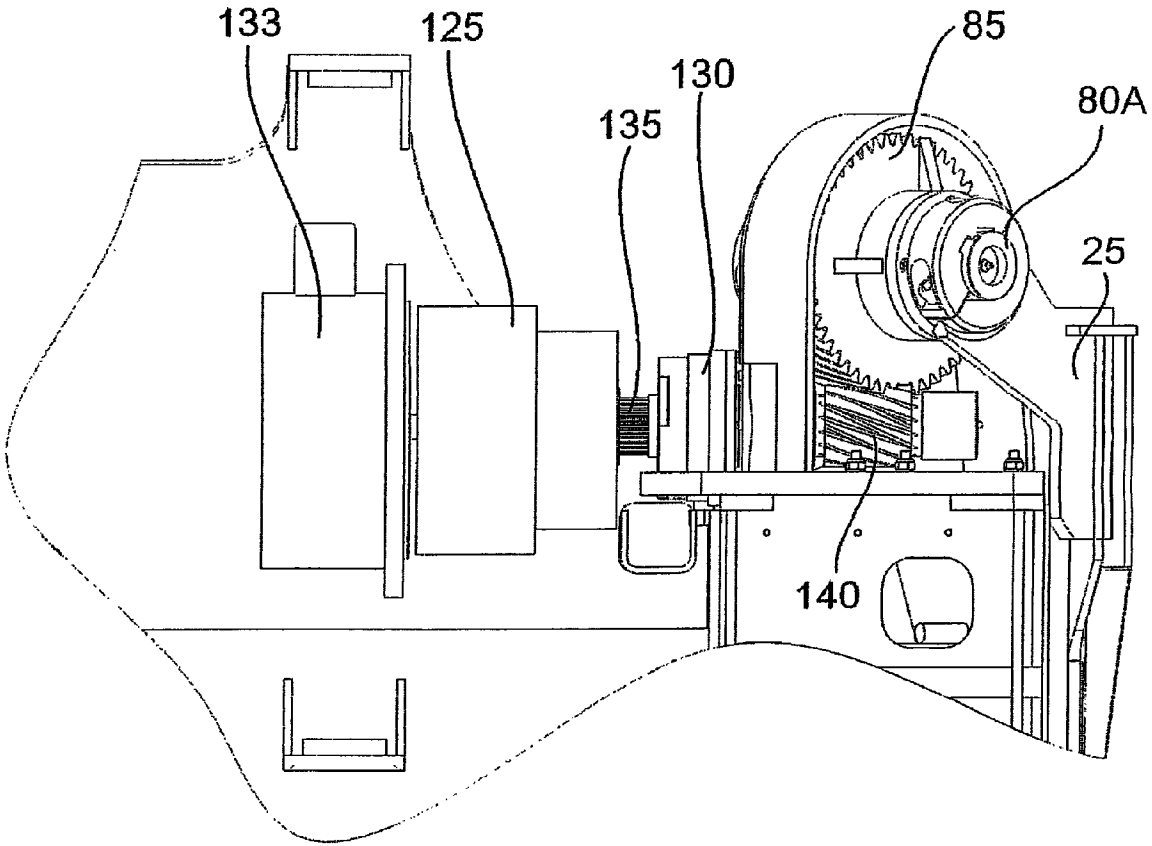

FIGS. 6A to 6C show an alternative arrangement of the spacing assembly 115. FIG. 6A shows two corners of the spreader frame 120 having two sets of spacing assemblies 115 to control movement of the corresponding flippers 25.

In this arrangement the coupled cross helical gears 85, 140 have a similar gear ratio to that shown in FIGS. 5A and 5B. The embodiment of FIGS. 6A to 6C makes use of this beneficial gear ratio by reducing the required rating from the gear box 125. A reduced gear box rating allows the use of an in-line gear box 125 which is mounted to a motor 133 and connected to the torque transmitter being the coupled cross helical gears 85, 140 through a shaft 135 and torque limiter 130.

The embodiment of FIGS. 6A to 6C demonstrates the advantage of the gear ratio of the torque transmitter assembly having a substantially more compact arrangement for the spacing assembly 115. The use of an in-line gear box and reduced rating torque limiter may also lead to a cost saving in the required equipment.

Figure 7A:
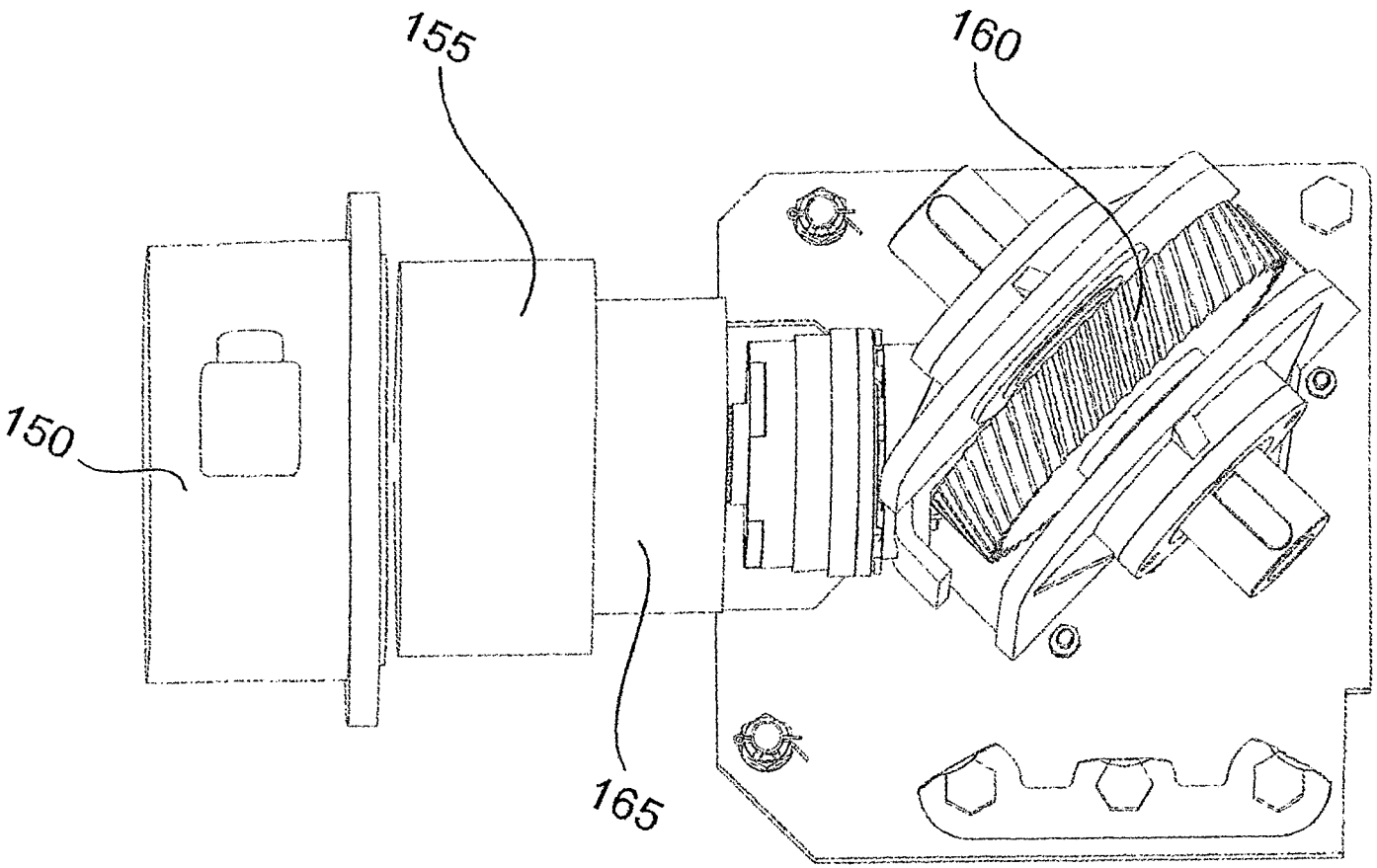
FIGS. 7A and 7B are various views of a spacing assembly according to a further embodiment of the present invention.
Figure 7B:
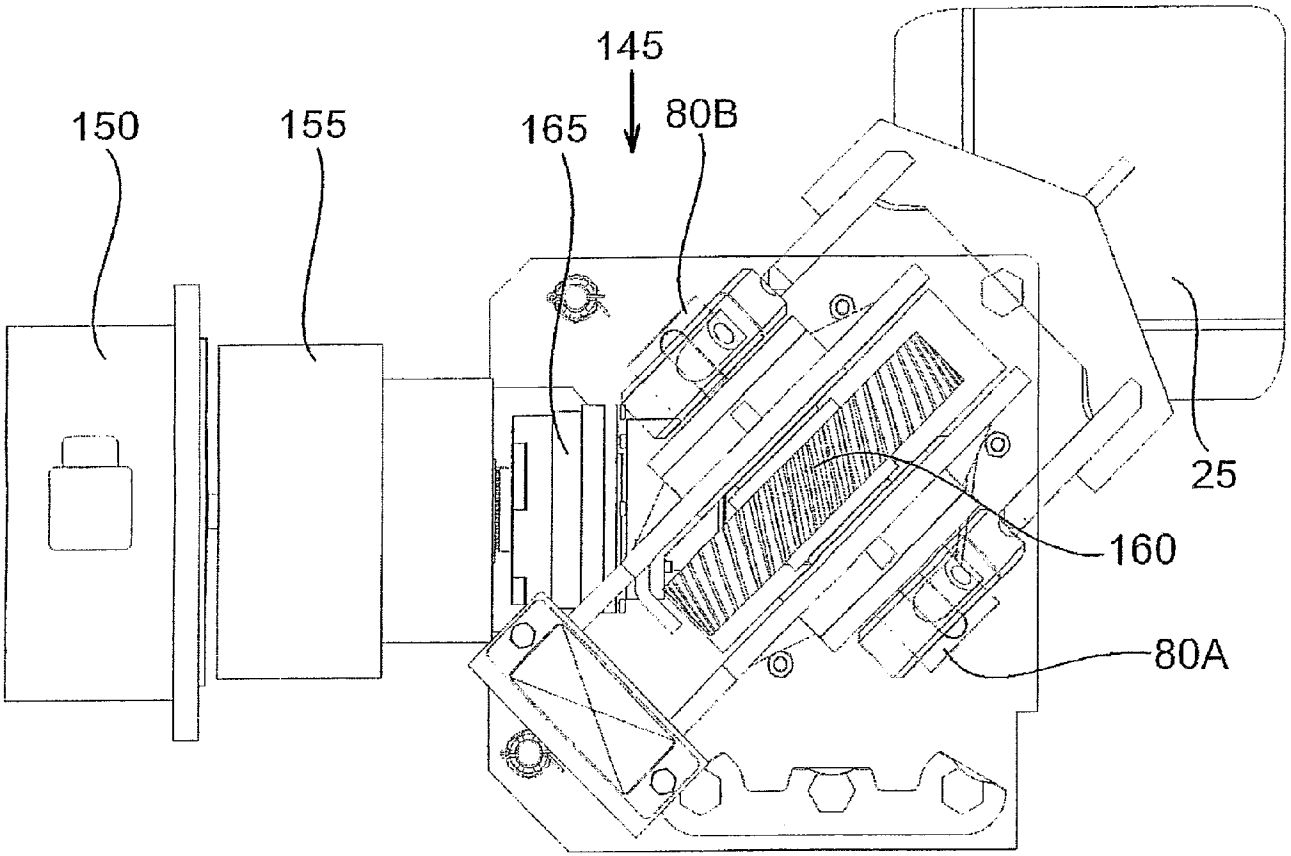

FIGS. 7A and 7B show a further alternative for the spacing assembly 145. Here a cross helical gear arrangement 160 again demonstrates a gear ratio similar to that previously discussed. And again a motor 150 and in-line gear box 155 are coupled to a torque limiter 165. Further advantage of the motor and in-line gear box permits a significant shortening of the shaft as compared to the previous embodiments. What is left is a further compact arrangement which meets the objective of driving the flipper whilst still being relatively distal therefrom. However, the compactness of the arrangement is such that it may fit comfortably on the spreader's frame providing significant space saving advantages.

Figure 8A:
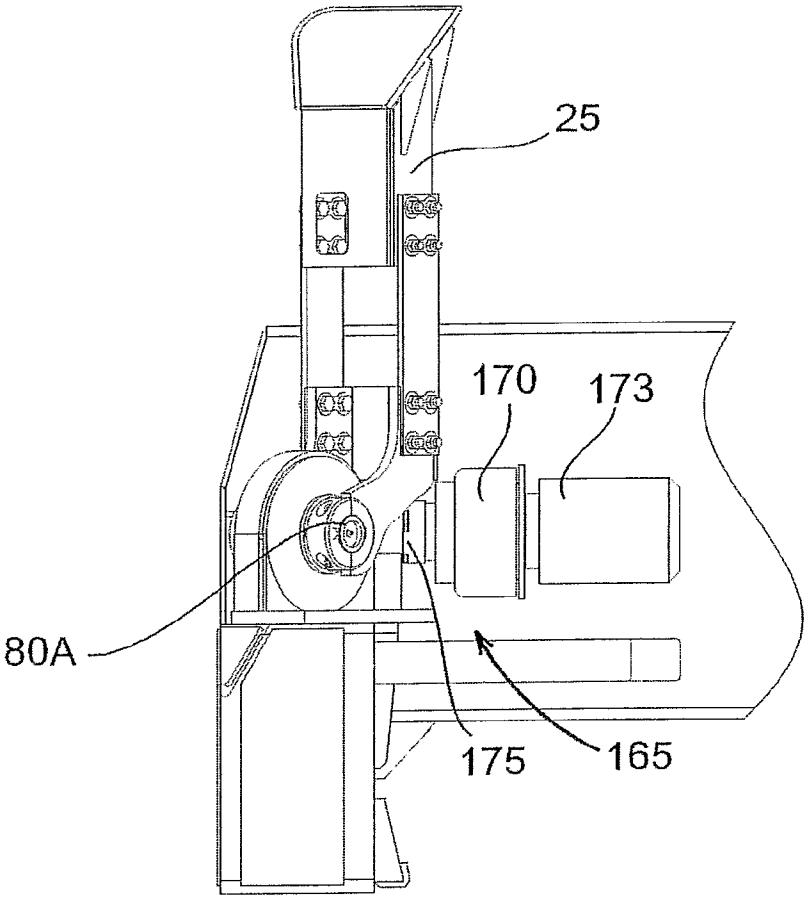
FIGS. 8A, 8B and 8C are various views of a spacing assembly according to a further embodiment of the present invention.
Figure 8B:
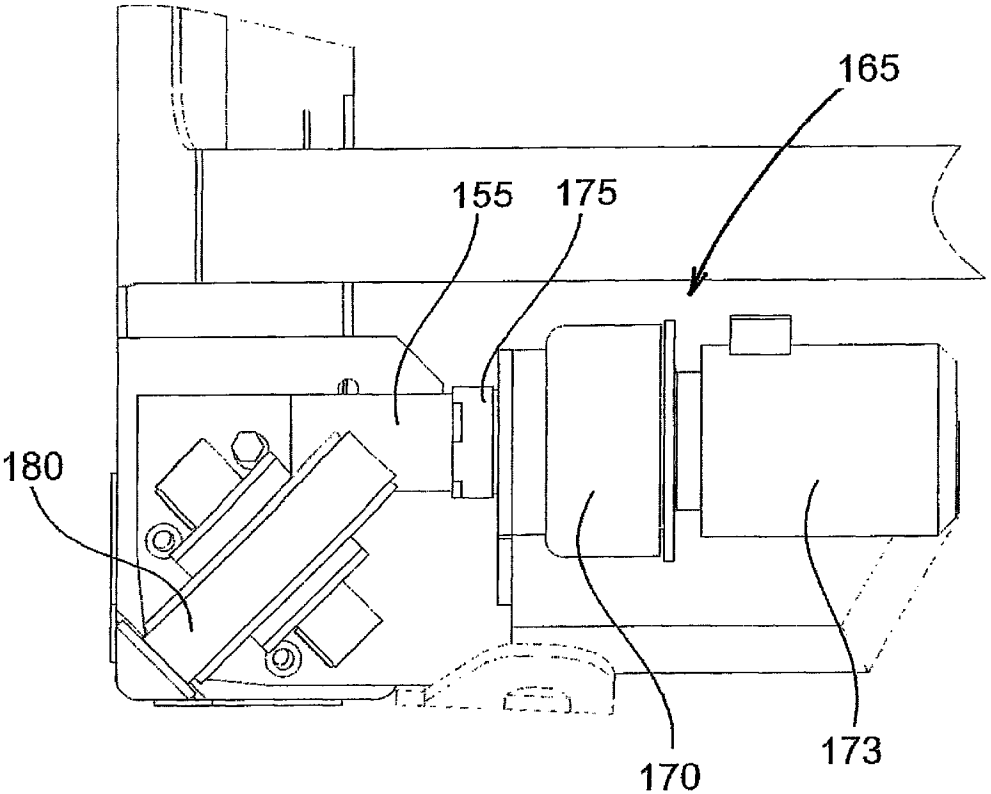
Figure 8C:
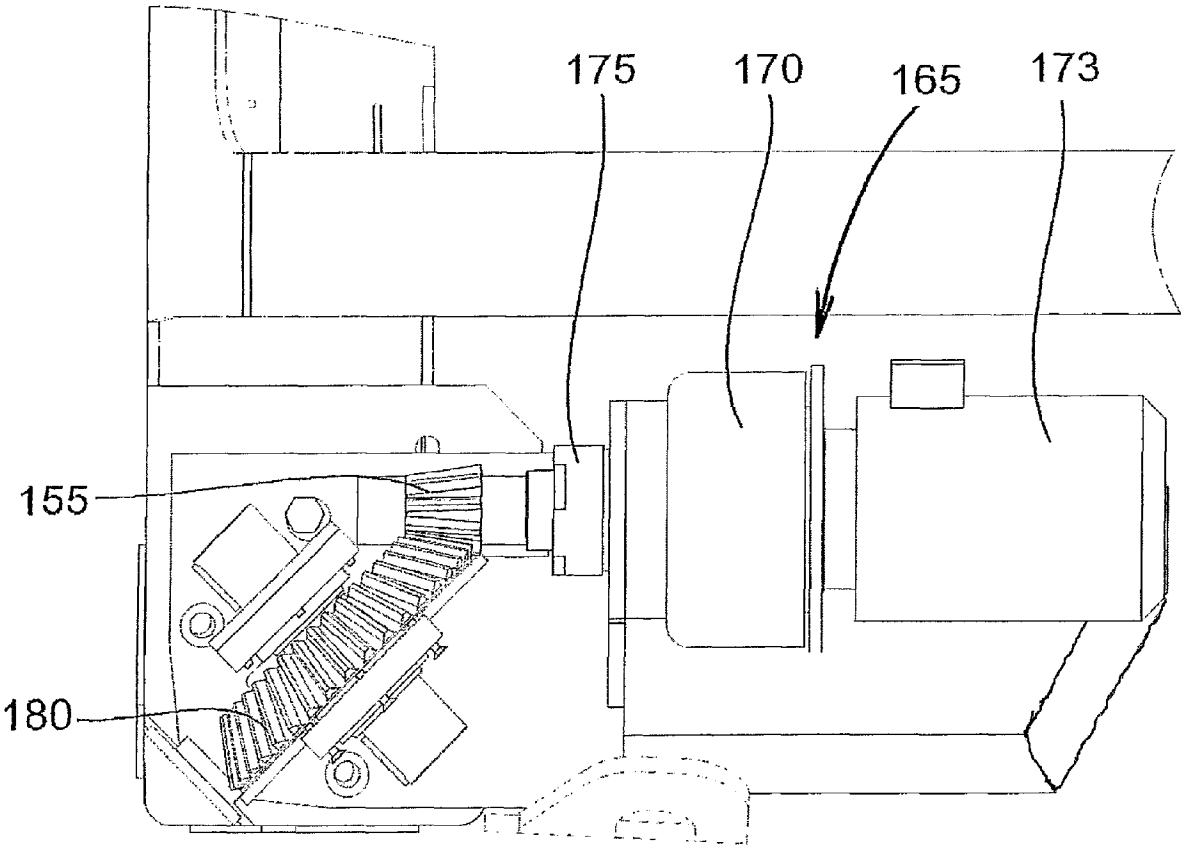

FIGS. 8A, 8B and 8C show a further alternative arrangement. In FIGS. 8A and 8B a motor 173 and gear box 170 is again coupled to a torque limiter 175. However, the torque transmitter in this case is a bevel gear arrangement 180, 155 replacing the cross helical gear. Similarly FIG. 8C shows the bevel gear 180, 155 arrangement in more detail whereby the motor/gear box 170 is coupled to the torque limiter 175.

As can be seen, the invention encompasses a range of different variations to the specific components, all of which meet the objectives of placing a suitably rated and protected assembly to drive the flipper on a spreader. Each alternative presents certain features adapted for particular conditions and so each having a particular situational advantage.

The invention claimed is:

1. A flipper assembly for guiding a spreader to engage a container, the flipper assembly comprising:

a flipper hingedly mounted to the spreader, said flipper moveable between an open position and a closed position about said hinged mounting;

a motor directly mounted to the spreader and being distal from said flipper; and a spacing assembly located between the motor and the hinged mounting of the flipper, the motor and the hinged mounting located on two opposite sides of the spacing assembly, respectively, wherein said spacing assembly is configured to transmit a torque from the motor to the hinged mounting so as to move the flipper between the closed position and the open position, and wherein the spacing assembly includes a torque limiter configured to provide for a slippage when the torque reaches a predetermined value so as to limit a transmission of the torque to the predetermined value.

2. The flipper assembly according to claim 1 wherein the spacing assembly comprises a shaft and a torque transmitter for transmitting torque through a specified angle.

3. The flipper assembly according to claim 2 wherein the torque transmitter includes any one of: a bevel gear arrangement, a dog clutch, and a helical gear arrangement.

4. The flipper assembly according to claim 2 wherein said torque transmitter includes transmitting torque to one portion of the hinged mounting.

5. The flipper assembly according to claim 4 wherein said hinged mounting includes two hinges, said portion of said hinged mounting including one of said hinges.

6. The flipper assembly according to claim 1 wherein said motor is a servo motor capable of providing a holding torque against a back drive torque.

7. The flipper assembly according to claim 1, wherein said motor includes a brake capable of providing a braking torque against a back drive torque.

8. The flipper assembly according to claim 7 wherein said brake is configured to be pre-set as a percentage of the rating of said motor.

9. The flipper assembly according to claim 1 wherein the motor is mounted to a mounting portion on said spreader, said mounting portion including a guard to protect the motor from an external impact.

10. A flipper assembly for guiding a spreader to engage a container, the flipper assembly comprising:

a flipper hingedly mounted to the spreader, said flipper moveable between an open position and a closed position about said hinged mounting;

a motor mounted to the spreader distal from said flipper; and a spacing assembly located between the motor and the hinged mounting of the flipper, wherein said spacing assembly is configured to transmit a torque from the motor to the hinged mounting so as to move the flipper between the closed position and the open position, wherein the spacing assembly includes a torque limiter configured to limit a transmission of the torque to a predetermined value, wherein the spacing assembly comprises a shaft and a torque transmitter for transmitting torque through a specified angle, wherein the torque transmitter includes any one of: a bevel gear arrangement, a dog clutch, and a helical gear arrangement, and wherein the torque transmitter is a cross helical gear arrangement having a gear ratio of at least 3:1.

11. The flipper assembly according to claim 10 wherein the spacing assembly includes a gear box, said gear box being in-line with said shaft.

12. A flipper assembly for guiding a spreader to engage a container, the flipper assembly comprising:

a flipper hingedly mounted to the spreader, the flipper moveable between an open position and a closed position about the hinged mounting;

a motor mounted to the spreader distal from the flipper; and a spacing assembly located between the motor and the hinged mounting of the flipper, wherein the spacing assembly is configured to transmit a torque from the motor to the hinged mounting so as to move the flipper between the closed and open positions, wherein the spacing assembly comprises a torque limiter configured to limit the transmission of the torque to a predetermined maximum value, and wherein the spacing assembly further comprises a shaft and a torque transmitter and is further configured to transmit the torque through a specified angle, wherein the torque transmitter is a bevel gear arrangement having a gear ratio of at least 3:1.

* * * * *